United States Patent [19]

Skaja

[11] 4,380,878

[45] Apr. 26, 1983

[54] OUTSOLE

[75] Inventor: Joseph J. Skaja, Newburyport, Mass.

[73] Assignee: Keds Corporation, Cambridge, Mass.

[21] Appl. No.: 191,265

[22] Filed: Sep. 26, 1980

[51] Int. Cl.[3] ..... A43C 15/00; A43B 5/00

[52] U.S. Cl. ..... 36/67 D; 36/129; 36/134

[58] Field of Search ..... 36/67 D, 59 A, 59 B, 36/59 C, 67 R, 32 R, 128, 129, 134

[56] References Cited

U.S. PATENT DOCUMENTS

| | | | |
|---|---|---|---|
| D. 231,584 | 5/1974 | Edmonds | D2/320 |
| D. 242,091 | 11/1976 | Tornero | D2/320 |
| 1,068,073 | 7/1913 | Perkins | 36/59 |
| 1,165,235 | 12/1915 | Emery | 36/59 |
| 1,299,037 | 4/1919 | Runyan | 36/59 |
| 1,524,997 | 2/1925 | Potter | 36/59 |
| 2,049,598 | 8/1936 | Tubbs | 36/67 D X |
| 2,330,458 | 9/1943 | Tubbs | 36/128 X |
| 2,745,197 | 5/1956 | Holt | 36/134 X |
| 3,486,249 | 12/1969 | Bernier et al. | 36/67 A |
| 3,662,478 | 5/1972 | Schwab | 36/59 C |
| 3,715,817 | 2/1973 | White et al. | 36/67 D |
| 3,808,713 | 5/1974 | Dassler | 36/32 R |
| 4,043,058 | 8/1977 | Hollister et al. | 36/102 |
| 4,085,527 | 4/1978 | Riggs | 36/32 R X |
| 4,141,158 | 2/1979 | Benseler et al. | 36/32 R |
| 4,212,120 | 7/1980 | Bowerman et al. | 36/129 |

FOREIGN PATENT DOCUMENTS

| | | |
|---|---|---|
| 1760262 | 7/1971 | Fed. Rep. of Germany . |

*Primary Examiner*—Richard J. Scanlan, Jr.

[57] ABSTRACT

An outsole for an athletic shoe features an integrally molded sole unit having outwardly extending receptacles located in the ball and heel area, and replaceable wear plugs mounted in the receptacles.

16 Claims, 7 Drawing Figures

OUTSOLE

FIELD OF THE INVENTION

This invention relates to athletic shoes, and more particularly to outsoles for such shoes.

BACKGROUND OF THE INVENTION

Athletic shoes, especially those used for running, should be both lightweight and durable. The outsoles of such shoes should be able to withstand the wear caused by many miles of training, and yet be flexible and not cause the shoe to be unacceptably heavy. Recent efforts have included searches for materials with desirable durability, flexibility, and weight. But outsole wear remains a problem which often limits the life of the shoe.

Another important characteristic of an outsole is its traction. Often materials which provide adequate traction for some running surfaces, e.g., dry blacktop, do not perform as well on others, e.g., dirt, wood, or wet blacktop. It would be desirable to have an outsole which provides optimum traction on all types of running surfaces and for all kinds of weather conditions.

Yet another important role of the outsole is its contribution to cushioning and to other properties of the shoe that affect the shoe's performance with respect to the specific biomechanical requirements of the user. One approach has been to customize the shoe to meet the needs of the individual by inserting specially designed orthotics inside the shoe. Such orthotics are generally difficult to fit and expensive.

SUMMARY OF THE INVENTION

I have invented an outsole that is both lightweight and flexible, and yet virtually eliminates the problem of wear. The traction characteristics of my outsole can be varied to provide optimum performance for all running surface conditions, and the cushioning and geometry of my outsole can be readily customized to meet the biomechanical needs of the individual user.

The invention features an integrally molded sole unit having outwardly extending receptacles located in the ball and heel area, and replaceable wear plugs mounted in the receptacles.

In preferred embodiments three wear plug receptacles are positioned in a triangular configuration in the ball area of the sole and a pair of receptacles are positioned laterally opposed one another in the heel area of the sole, the areas of greatest wear; the outer end of each wear plug has a circumferential lip portion, and each receptacle has a corresponding rim portion which extends outwardly beyond the lip of the plug to prevent edge lift of the plug; each receptacle is flared at the end connected to the sole unit to provide greater resistance to material fatigue as the shoe flexes; a bar unit extending around the perimeter of the outsole and studs positioned transverse to the longitudinal axis of the sole contact the ground, but do not bear any load, to provide enhanced stability; this perimeter bar is discontinuous and tapered in the region adjacent the toe to provide increased flexibility and to decrease the weight of the outsole; and the wear plugs are varied in height and composition to customize the sole characteristics to meet the needs of the particular user and to optimize the traction of the sole in light of specific running surface conditions.

PREFERRED EMBODIMENT

The structure and operation of a preferred embodiment of the invention will now be described, after a brief description of the drawings.

DRAWINGS

Figure 2:
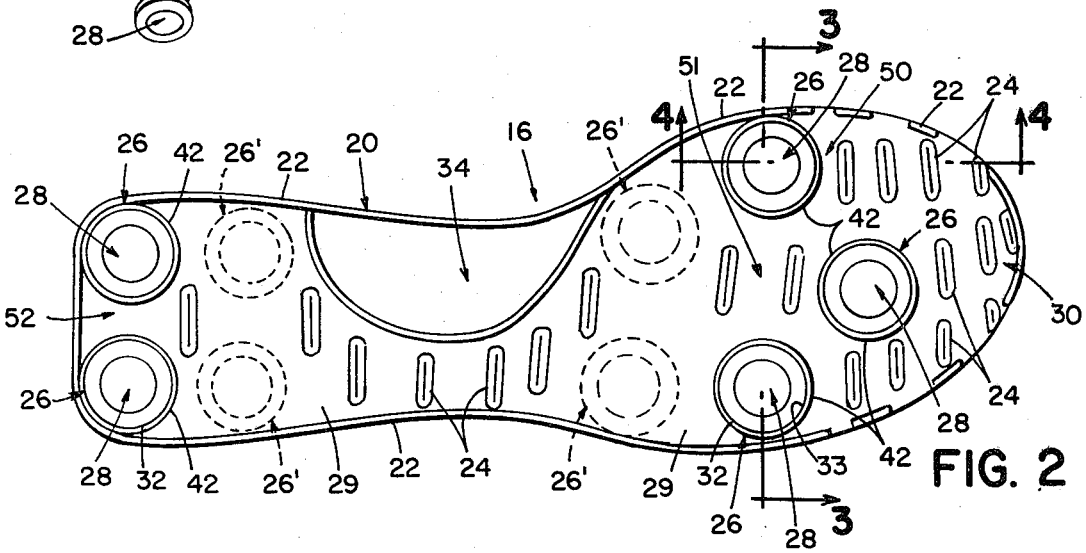
FIG. 2 is a plan view of the bottom of the outsole of FIG. 1.
Figure 3:
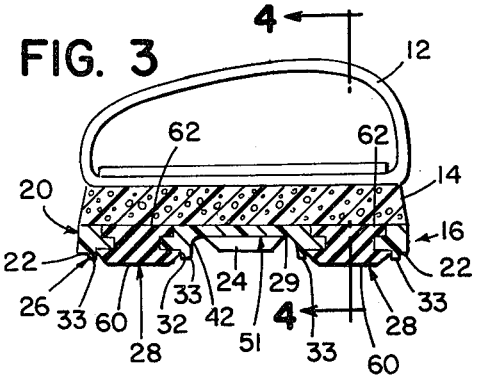
Figure 4:
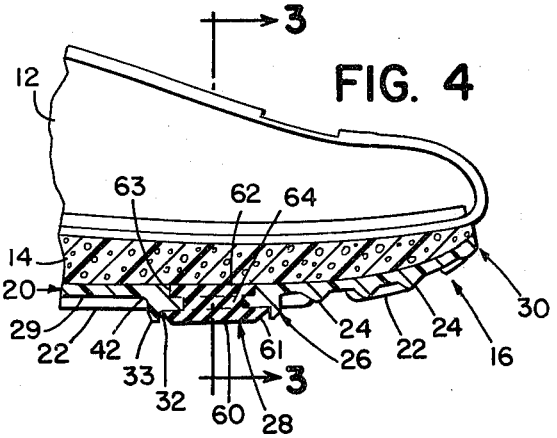

FIGS. 3 and 4 are respectively sections through 3—3 and 4—4 of FIG. 2.

Figure 1:
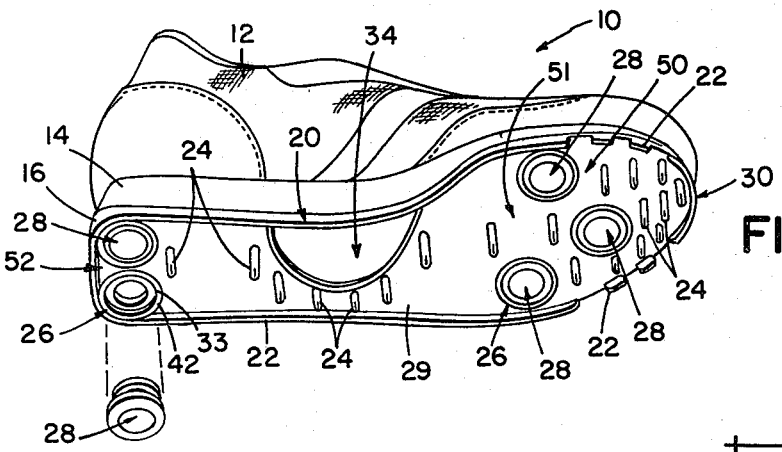
FIG. 1 is a perspective view of an athletic shoe having an outsole according to the invention.
Figure 5:
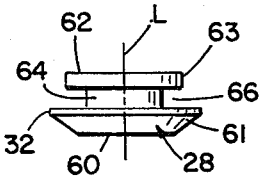

FIG. 5 is an elevation of one of the wear plugs shown in FIG. 1.

Figure 6:
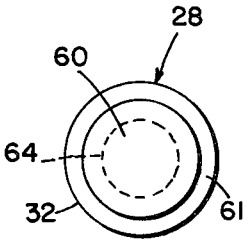
Figure 7:
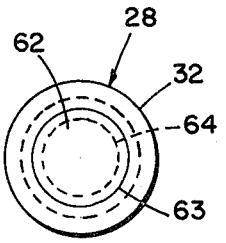

FIGS. 6 and 7 are respectively bottom and top views of the plug of FIG. 5.

STRUCTURE AND OPERATION

FIG. 1 shows a shoe 10 having a nylon upper 12 connected to a foam midsole 1 which is in turn connected to an outsole 16.

Referring to FIGS. 1 and 2, outsole 16 includes an integrally molded thin (0.060 inch thick) sole unit 20 having a raised perimeter bar 22, studs 24, and receptacles 26 of moldable flexible material with a hardness range of 50–90 on the Shore A scale (preferably polyester polyurethane with a 75–85 Shore A hardness) and replaceable plugs 28 of synthetic rubber (preferably SBR rubber compound) with a hardness range of 50–60 on the Shore A scale.

In the region adjacent plugs 28, perimeter bar 22 extends outwardly 0.125 inch from flat portion 29 of sole unit 20. As best shown in FIGS. 3 and 4, the outer ends 60 of the plugs extend slightly beyond the outer end of the perimeter bar. This difference is just enough for the perimeter bar to contact the ground, but not bear any significant (i.e., wear-producing) load, when subjected to the weight of the user. As shown in FIGS. 1 and 2, in the region 30 adjacent the toe of shoe 10, bar 22 is discontinuous and tapered in height to decrease weight and increase flexibility.

As best shown in FIGS. 3 and 4, each of the plug receptacles 26 extends outwardly from flat portion 29 of sole 20 beyond the circumferential lip portion 32 of its plug 28 to provide a protective rim 33 which acts to prevent edge lift of the plug. Base 42 of each receptacle 26 is flared to distribute the load and prevent material fatigue as the shoe flexes.

Studs 24 positioned generally transverse to the longitudinal axis of the outsole further increase stability. As shown in FIG. 4, the studs are triangular in transverse section to decrease the weight of the outsole. Moreover, to further decrease weight, there are no studs in light load bearing arch region 34 (FIG. 2).

As shown in FIGS. 1 and 2, three receptacles 26 are positioned in a triangular plug configuration in ball area 50 of the outsole, one receptacle near the inner or medial edge and the other two receptacles near the outer or lateral edge, leaving the middle metatarsal area 51 free. There are two laterally opposed receptacles 26 positioned as far back on heel area 52 as possible. Four additional receptacles 26' may be provided adjacent arch area 34, as shown in phantom in FIG. 2.

This plug configuration not only provides good stability, but also positions the plugs in the areas of greatest wear.

Turning now to FIGS. 5–7, a plug 28 is shown in greater detail. Outer end 60 of the plug has a beveled portion 61 which is at a 60 degree angle to axis L of the plug. Inner end 62 of the plug has a transversely extending cylindrical portion 63, which defines, together with outer end 60 and shank 64, an annular groove 66. Ends 60 and 62 and shank 64 are each 0.125 inch in the axial direction, for an overall plug thickness of ⅜ inch. A plug this thick will function properly, and yet the outsole weight will be kept to a minimum. The lip portion 32 of end 60 is 0.03125 inch. End 60, shank 64 and end 62 are 0.990 inch, 0.50 inch, and 0.750 inch in diameter, respectively.

In operation, when a plug 28 becomes worn, it is removed, for example, by prying it out of its receptacle 26 with a screwdriver, and a new plug 28 is snapped into the receptacle by hand. Because the plugs are mechanically locked in placed (without the need, e.g., for screws or adhesive bonding) such replacement is easily accomplished by a user with minimal dexterity.

Plugs of varying heights and/or varying compressive materials may be selectively inserted in the receptacles 26 to accommodate the user's particular biomechanical requirements and to enable the user to achieve various localized shock absorption or cushioning properties in specific sole locations.

Plugs of several different materials and combinations of materials (including metals) may be quickly changed or interchanged to achieve optimum traction depending on the weather and running surface conditions. Also, various traction differentials can be achieved within the sole through different plug configurations. For example, the heel could be arranged to have less traction than the ball area.

What is claimed is:

1. An outsole for an athletic shoe comprising:

a flexible integrally molded sole unit, said sole unit having multiplicity of outwardly extending receptacles integrally molded at the ball and heel portions of said sole unit, said receptacles having integral wall portions, plugs demountably held by said receptacles, said plugs having surfaces in contact with and held by said wall portions, said sole unit having an outwardly extending bar unit around the perimeter thereof, and said perimeter bar being discontinuous and tapered in height in the region adjacent the toe of said shoe.

2. The outsole of claim 1 wherein there are three of said receptacles positioned in a triangular configuration in the ball portion of said sole unit.

3. The outsole of claim 2 wherein one of said three receptacles is positioned adjacent the medial edge of said sole unit, and the other two of said three receptacles are positioned adjacent the lateral edge of said sole unit, leaving the middle metatarsal area thereof free.

4. The outsole of claim 1 wherein there is a pair of said receptacles positioned laterally opposed one another in the heel portion of said sole unit.

5. The outsole of claim 1 wherein the outer end of each of said plugs has a circumferential lip portion, and each of said receptacles has a corresponding circumferential rim portion which extends outwardly beyond said lip portion when a plug is inserted therein, whereby said rim acts to prevent edge lift of said plug.

6. The outsole of claim 9 wherein each of said receptacles is flared at the end connected to the sole unit.

7. The outsole of claim 1 wherein the outer ends of said plugs extend beyond the outer end of said perimeter bar by an amount effective to permit the perimeter bar to contact the ground but not bear any significant load when said shoe is subjected to the weight of the user.

8. The outsole of claim 7 wherein said sole unit has a multiplicity of studs positioned adjacent said receptacles, said studs extending outwardly from said sole unit the same distance as said perimeter bar.

9. The outsole of claim 1 wherein said sole unit has a multiplicity of outwardly extending studs positioned adjacent said receptacles.

10. The outsole of claim 9 wherein the longitudinal axis of each of said studs is transverse to the longitudinal axis of said outsole.

11. The outsole of claim 9 wherein said studs are triangular in transverse section.

12. The outsole of claim 9 wherein said plugs are varied in height by predetermined amounts.

13. The outsole of claim 12 wherein said plugs are selectively varied compressive materials.

14. The outsole of claim 9 wherein said plugs are materials with selectively varied frictional characteristics.

15. The outsole of claim 9 wherein said plugs are synthetic rubber with a hardness range of 50 to 60 on the Shore A scale.

16. The outsole of claim 9 wherein said sole unit is on the order of 0.060 inch thick polyester polyurethane with a hardness range of 50 to 90 on the Shore A scale.

* * * * *